US009593494B2

(12) United States Patent
Frenette

(10) Patent No.: US 9,593,494 B2
(45) Date of Patent: Mar. 14, 2017

(54) TRANSITION STRIP

(71) Applicant: Chad Marcus Frenette, Barrie (CA)

(72) Inventor: Chad Marcus Frenette, Barrie (CA)

(73) Assignee: Chad Marcus Frenette, Barrie, Ontario (CA)

( * ) Notice: Subject to any disclaimer, the term of this patent is extended or adjusted under 35 U.S.C. 154(b) by 193 days.

(21) Appl. No.: 13/951,088

(22) Filed: Jul. 25, 2013

(65) Prior Publication Data

US 2015/0027077 A1 Jan. 29, 2015

(51) Int. Cl.
*E04F 19/02* (2006.01)
*E04F 19/06* (2006.01)

(52) U.S. Cl.
CPC ..... *E04F 19/063* (2013.01)

(58) Field of Classification Search
CPC ..... E04F 19/02; E04F 19/062; E04F 19/06; E04F 19/065; E04F 15/02; E04F 15/02016; E04B 1/6803; A47G 27/045; A47G 27/0431; F16B 5/00; F16B 5/0635; F16B 5/0607
USPC ..... 52/459, 461, 465, 468, 716.1, 717.03, 52/717.06, 460, 464, 467, 469
See application file for complete search history.

(56) References Cited

U.S. PATENT DOCUMENTS 3,411,977 A * 11/1968 Slater, Jr. ..... 428/33
D249,965 S 10/1978 Cooper
4,893,449 A * 1/1990 Kemper ..... 52/464
6,550,192 B1 4/2003 Nelson et al.
6,550,205 B2 * 4/2003 Neuhofer, Jr. ..... 52/464
7,784,238 B2 8/2010 Bannister
8,051,605 B2 * 11/2011 Rissone ..... 49/467
8,122,665 B2 2/2012 Stanchfield et al.
8,161,708 B2 4/2012 Schacht et al.
8,186,118 B2 * 5/2012 Neuhofer ..... 52/465
8,205,410 B2 6/2012 Stanchfield
8,245,473 B2 8/2012 Schacht
8,266,865 B2 * 9/2012 Neuhofer, Jr. ..... 52/716.8
8,327,595 B2 12/2012 Stanchfield
8,448,399 B2 5/2013 Kornfalt et al.
8,572,919 B1 * 11/2013 Neill et al. ..... 52/466
2001/0005539 A1 * 6/2001 Neuhofer, Jr. ..... 428/122
2002/0095895 A1 * 7/2002 Daly et al. ..... 52/464
2003/0051426 A1 * 3/2003 Kornfalt ..... E04F 15/04 52/396.1
2003/0084634 A1 5/2003 Stanchfield
2006/0150565 A1 * 7/2006 Schacht ..... E04F 15/02005 52/716.1
2007/0056239 A1 * 3/2007 Schacht et al. ..... 52/582.1
(Continued)

*Primary Examiner* — Brian Mattei
*Assistant Examiner* — Gisele Ford
(74) *Attorney, Agent, or Firm* — Eugene J. A. Gierczak

(57) ABSTRACT

A transition strip for covering a gap between two spaced floor finishes on a subfloor comprising: a strip extending along a longitudinal axis and presenting in cross-section to said longitudinal axis: an upper surface adapted for covering the gap; spaced first and second legs depending from said strip, said first leg longer than said second leg; a first lower surface portion extending outwardly from said first leg said first lower surface portion adapted to cover one edge of the two spaced floor finishes; a second lower surface portion extending outwardly from said second leg, said second lower portion adapted to cover an edge of the other one of the two spaced floor finishes. A method for installing transition strips is also described.

14 Claims, 7 Drawing Sheets

(56) References Cited

U.S. PATENT DOCUMENTS

| | | | | |
|---|---|---|---|---|
| 2008/0034696 | A1* | 2/2008 | Neuhofer | 52/466 |
| 2009/0071089 | A1* | 3/2009 | Neuhofer, Jr. | 52/469 |
| 2010/0031596 | A1* | 2/2010 | Muehlebach | 52/466 |
| 2013/0283717 | A1* | 10/2013 | Smith | 52/465 |

* cited by examiner

TRANSITION STRIP

FIELD OF INVENTION

This invention relates to a member for covering an edge of a floor finish on a subfloor and particularly relates to a transition strip for covering, a gap between two spaced floor finishes on a subfloor including the method for covering the gap.

BACKGROUND TO THE INVENTION

Many homes have a variety of floor finishes that are applied to the subfloor or substrate. For example, the floor finishes can include hardwood floors, wooden floors, carpet, vinyl, ceramic tile, composites of wood, resins, plastics or the like.

Typically, transition strips that extend longitudinally thereof have been used to cover the gap between the edges of the different floor finishes. In some cases, the height or thickness of the floor finishes are the same. In other cases, the height or thicknesses of the two spaced adjacent floor finishes are different. For example, one floor finish could be hardwood which typically has a thickness of ¾ of an inch, while the adjacent floor finish could be vinyl which has a much thinner height or thickness. Accordingly, a plurality of different transition strips have been used in the prior art.

For example, FIG. 1*a-d* illustrate some of the prior art transition strips. FIG. 1*a* shows a cross-section or profile of a transition strip or reducer which has been used for vinyl. In one orientation, a side 2 would abut against a hardwood floor while bottom portion 4 would overlie the vinyl (not shown).

FIG. 1*b* illustrates a "T" cross-section of a transition strip which has been used in the prior art between wood and tile. One side of the transition strip 6 would overlie the wood and the other side 8 would overlie the tile. The intermediate member 10 would be disposed in the gap between the wood and tile.

FIG. 1*c* illustrates a prior art carpet reducer or transition strip where one side 12 in one orientation would abut against a wood flooring while another side 14 would overlie the carpet.

FIG. 1*d* shows another example of a prior art vinyl reducer where one side 16 could overlap wood or ceramic tile while another side 16 would overlap the vinyl.

Accordingly, during an installation process, one would need to bring a variety of transition strips such as for examples shown in FIGS. 1*a*-1*b* in order to accommodate all of the different types of floor finishes that could be used between adjoining rooms or finishes.

It is generally expensive and time consuming to bring or to remember to bring all of the different varieties of transition strips that could be used.

Accordingly, there is a need to utilize a universal or single transition strip which can be used for a variety of different floor finishes.

Furthermore, there have been a variety of other types of transition strips and methods for accommodating, covering different finishes which have the same or different heights. For example, the following prior art patents illustrate some of these devices and methods.

For example U.S. Pat. No. 8,327,595 B2 relates to assembly includes a molding having a foot, a first arm, and a second arm. The foot is positioned along a longitudinal axis, and the first arm extends generally perpendicularly from the foot. The second arm extends generally perpendicularly from the foot. A tab depends generally perpendicularly from the first panel engaging surface. At least one of the tab and the foot engage the edge in order to tightly fit within the gap. The method includes the steps of placing the foot in the gap, pressing the respective panel engaging surfaces into contact with respective panels, and configuring at least one of the tab and the foot to cooperate to retain the molding in the gap when the assembly is in an installed condition.

Also United States Publication No. 2003/0084634 illustrates a joint cover assembly for covering a gap adjacent an edge of a panel that covers a sub-surface, and a method of covering such a gap.

Moreover U.S. Pat. No. 8,245,473 relates to finishing profile comprising a body with at least two portions made separable from each other, which, in the unseparated condition, are connected to each other by means of a break-off or cut-off zone, wherein, by whether or not removing one or more of the aforementioned two portions, various application possibilities of the remaining portion of the body are created, wherein, at least on the aforementioned two portions of the body, a layer-shaped covering is provided, wherein said layer-shaped covering shows an interruption at least over part of the length of the finishing profile, at the height of the transition between said two portions.

Furthermore U.S. Pat. No. 8,205,410 relates to a joint cover assembly for covering a gap adjacent an edge of a panel that covers a sub-surface, and a method of covering such a gap. The assembly includes a molding having a foot, a first arm, and a second arm. The foot is positioned along a longitudinal axis of the molding, and the first arm extends generally perpendicularly to the foot. The second arm may also extend generally perpendicularly to the foot. A tab depends from at least one of the first and second arms. At least one of the tabs and the foot engage a track in order to position the assembly over the gap. The method includes the steps of placing the foot in the gap, pressing the respective panel engaging surfaces into contact with respective panels, and configuring at least one of the tab and the foot to cooperate to retain the molding in the gap when the assembly is in an installed condition.

U.S. Pat. No. 8,161,708 teaches a finishing set for a floor covering, whereby this finishing set at least consists of, on the one hand, a finishing profile and, on the other hand, a holder with at least an attachment portion for attaching said finishing profile at the holder, characterized in that the holder comprises an underlay portion, which at choice can or cannot be provided underneath the remaining portion of the holder, as well as stop-forming positioning portion.

U.S. Pat. No. 8,122,665 B2 shows a joint cover assembly for covering a gap adjacent an edge of a panel that covers a sub-surface, and a method of covering such a gap. The assembly can be manipulated to form an end molding, a T-molding, a hard surface reducer, a carpet reducer, and/or a stair nose molding.

Furthermore U.S. Pat. No. 7,784,238 B2 teaches moulding that is installed at the transition between adjoining floor coverings/surfaces, such as between carpet and laminate floor coverings. The moulding includes a contoured cap and a depending wall portion having a series of vertically spaced rib portions along its lower edge that snap into the channel of a base track that is mounted to the subfloor.

Moreover U.S. Pat. No. 8,448,399 B2 relates to a thin decorative thermosetting laminate of postforming quality that is glued to a longitudinal carrier to form a floor strip. The laminate has a thermosetting resin as well as hard particles impregnated therein to increase the abrasion resistance of the laminate. The carrier generally has a cross section of a dilatation, transition or a finishing profile, depending on the intended use of the floor strip. The floor strip has a tab portion on a surface that engages a channel on a floor tile or a reducer. The tab portion locks the floor strip into place and prevents movement of the floor tile or the reducer with respect to the floor strip.

U.S. Pat. No. Des. 249,965 shows the ornamental design for a trim strip for partition wall.

Finally U.S. Pat. No. 6,550,192 B1 relates to molding systems ate described that include molding strips releasibly insertable into a mounting strip or track. The molding systems act as a transition between tile, both with and without backerboard support, and a floor or various floor coverings, including carpet, or wood flooring. Other molding systems are used to form, a transition between tile, with or without backerboard and door threshold plates. In another embodiment, a molding system is provided for covering an edging strip used to secure the edge of a carpet.

It is an object of this invention to provide an improved transition strip and method of installing same. Furthermore, it is another object of this invention to provide a universal or essentially a single transition strip which obviates the need to utilize a plurality of different prior art profile reducers or transition strips. It is also an object to simplify the method of installing transition strips.

SUMMARY OF INVENTION

It is an aspect of this invention to provide a member for covering an edge of a floor finish on a subfloor where the member extends longitudinally thereof to present an upper surface, and a lower surface, first and second space supports depending intermediate the lower surface to present a first lower surface portion and a second lower surface portion where one of said first and second lower surface portions contacts said edge, and said first support is longer than said second support.

It is another aspect of this invention to provide a transition strip for covering a gap between two spaced floor finishes an a subfloor comprising:

(a) a strip extending along a longitudinal axis and presenting in cross-section to said longitudinal axis:
  (i) an upper surface adapted for covering the gap;
  (ii) spaced first and second legs depending from said strip, said first leg longer than said second leg;
  (iii) a first lower surface portion extending outwardly from said first leg said first lower surface portion adapted to cover one of the two spaced floor finishes;
  (iv) a second lower surface portion extending outwardly from said second leg, said second lower portion adapted to cover the other one of the two spaced floor finishes.

Yet another aspect of this invention relates to a method of covering a gap between a first and second spaced floor finish on a substrate comprising:

(a) placing a transition strip having an upper surface and two spaced legs depending from said strip, wherein one of the legs is longer than the other, and the legs are disposed within the gap;
(b) selectively orientating the transition strip where the upper surface covers the gap and;
  (i) is substantially horizontal relative the substrate with the legs spaced from the substrate; or
  (ii) disposed at a first acute angle relative the substrate where both legs contact the substrate; or
  (iii) disposed at a second acute angle relative to the substrate where one of the legs contacts the substrate and the second leg has been removed.

These and other objects and features will now be described in relation to the following drawings.

DETAILED DESCRIPTION OF THE INVENTION

Figure 1A:
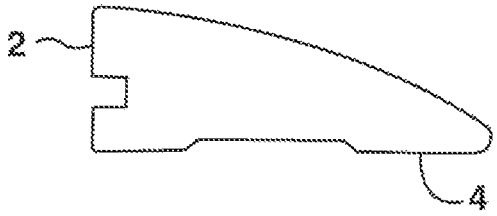
FIG. 1a (Prior Art)
FIG. 1*a-d* show prior art transition strips.
Figure 1B:
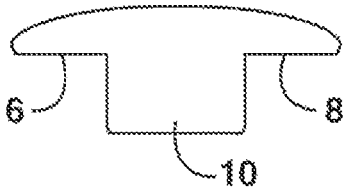
FIG. 1b (Prior Art)
Figure 1C:
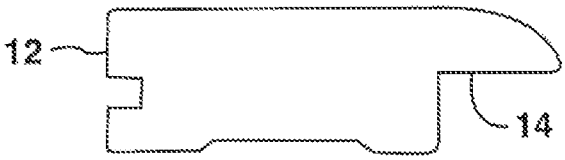
FIG. 1c (Prior Art)
Figure 1D:
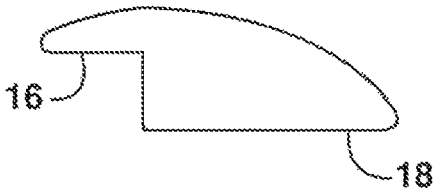
FIG. 1d (Prior Art)

Like parts have been given like numbers throughout the figures. In the drawings, embodiments of the invention as illustrated by way of example, it is expressly understood that the description and drawings are only for the purpose of illustration and as an aid to understanding, and are not intended as a definition of the limits of the invention.

FIG. 1*a-d* illustrates prior art transition strips or reducers.

The remaining figures illustrate the transition strip that can be used in the place of prior art transition strips.

Figure 1:
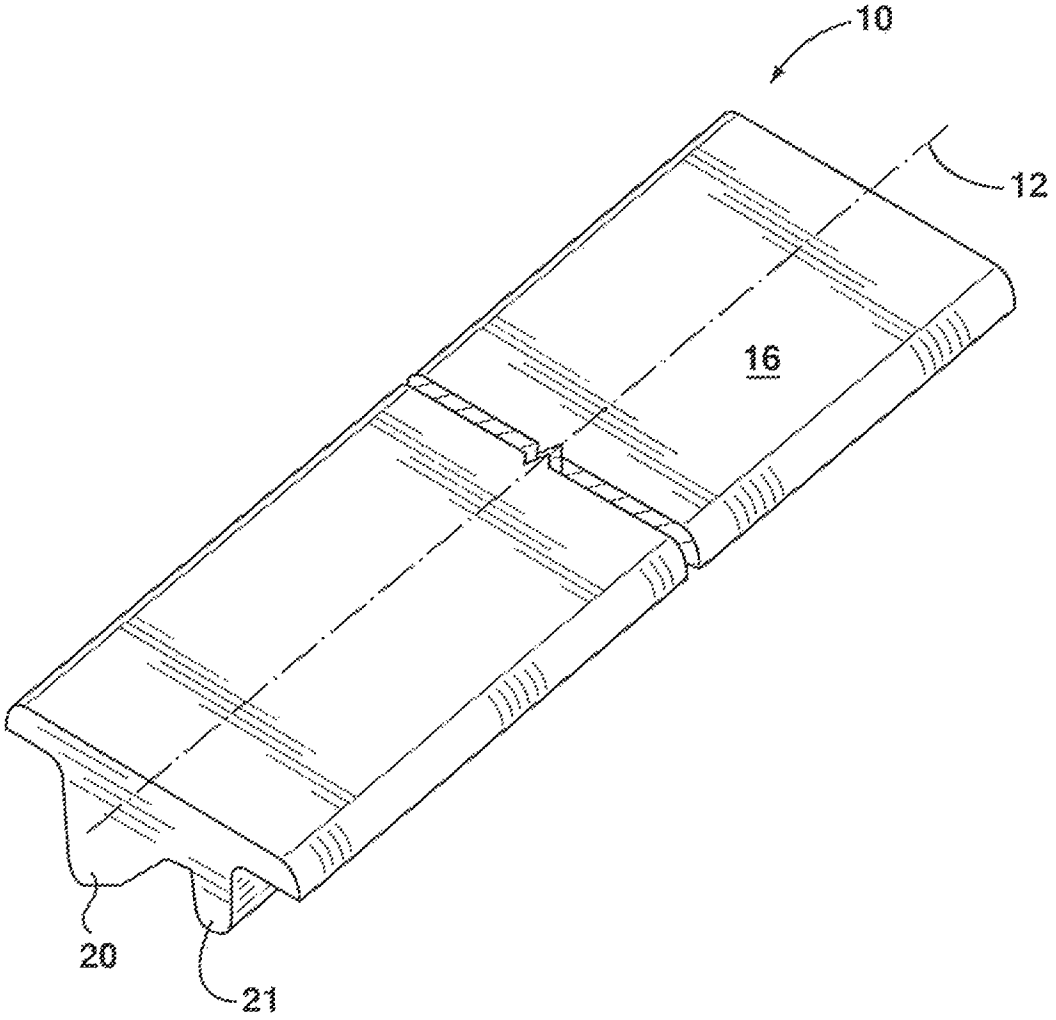
FIG. 1 is a partial top perspective view of the TRANSITION STRIP.
Figure 2:
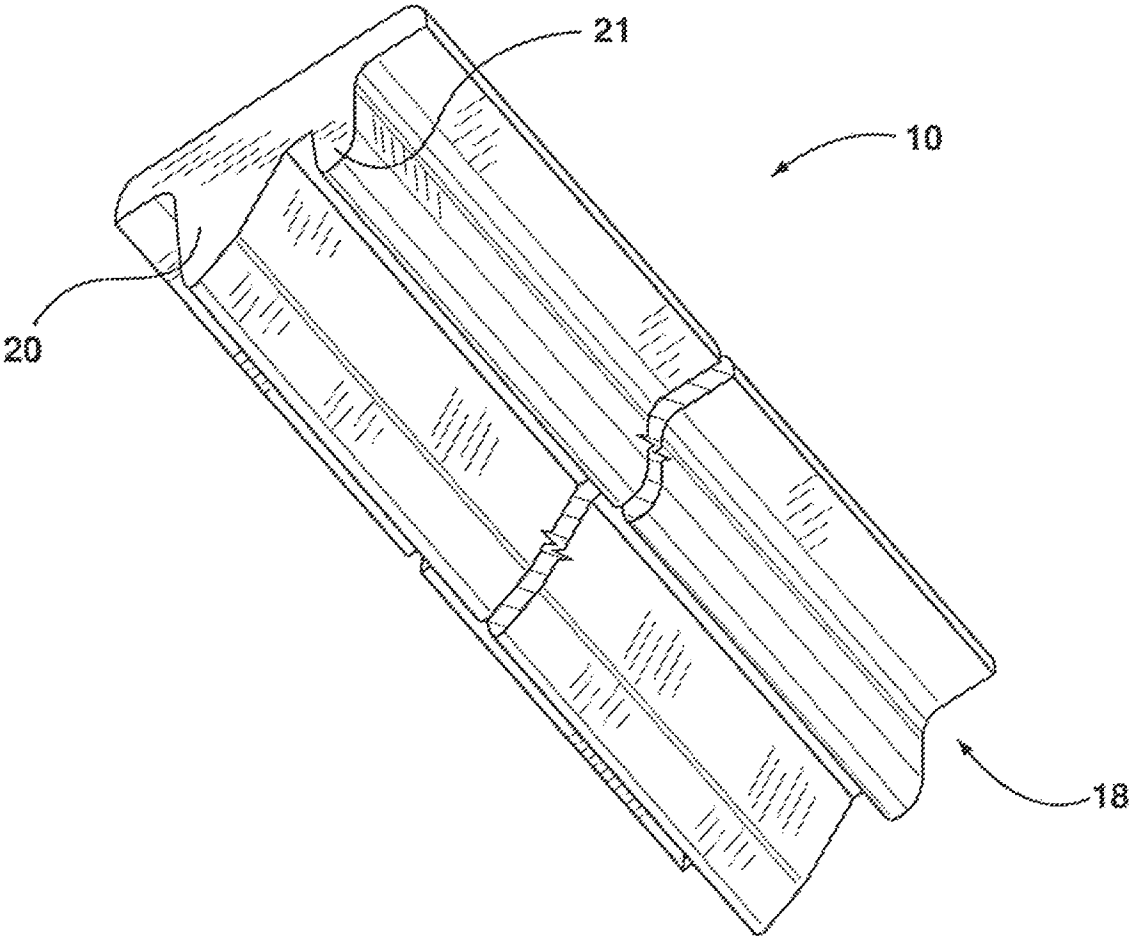
FIG. 2 is a partial bottom perspective view of the TRANSITION STRIP.

FIGS. 1 and 2 generally illustrate the transition strip or reducer, or sometimes called member for covering an edge of a floor finish 10.

In particular, the transition strip 10 extends longitudinally thereof along a longitudinal axis 12 to present an upper surface 16 and a lower surface 18. The lower surface 18 presents first and second spaced supports or legs 20 and 21 where one of the first supports 20 is longer than the second support or leg 21.

Figure 3:
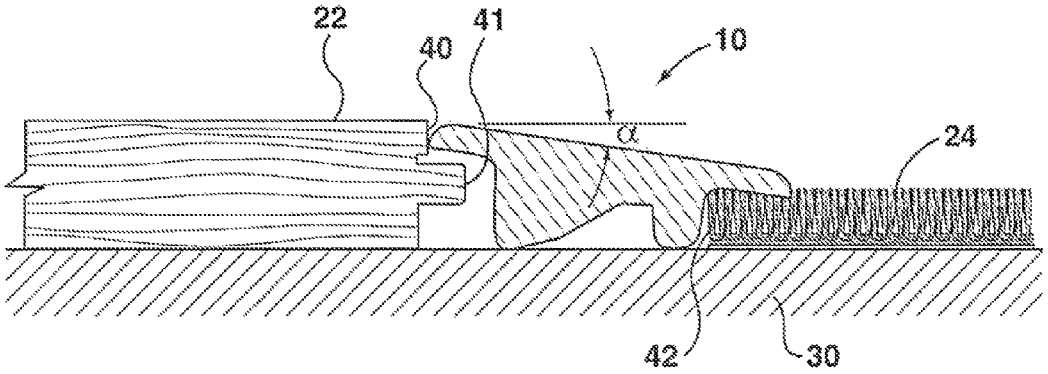
FIG. 3 illustrates one orientation of the TRANSITION STRIP
Figure 4:
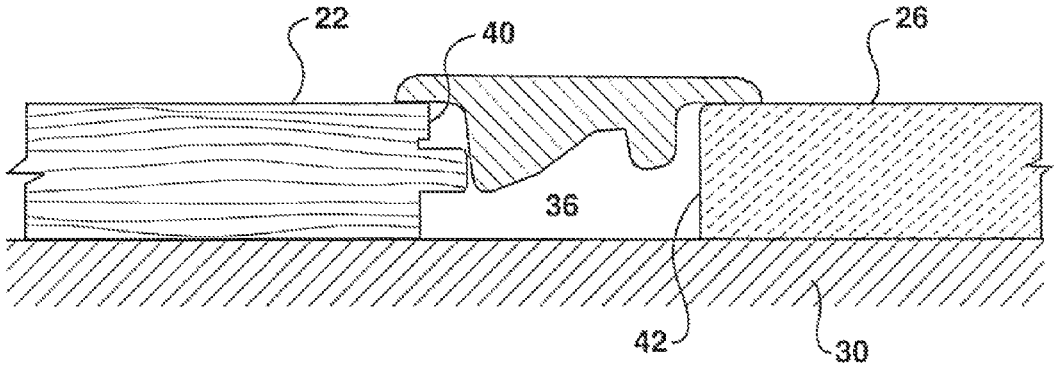
FIG. 4 illustrates another orientation of the TRANSITION STRIP.
Figure 5:
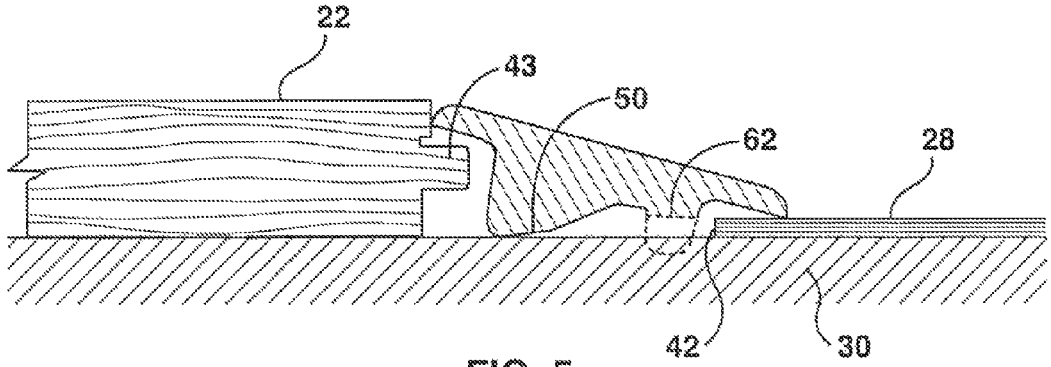
FIG. 5 illustrates yet another orientation of the TRANSITION STRIP.

FIG. 3 illustrates the use of the transition strip 10 in relation to hardwood floor 22 and carpet 24. FIG. 4 illustrates the use of the transition strip 10 in relation to hardwood floor 22 and a ceramic tile 26. FIG. 5 illustrates the use of the transition strip 10 in relation to hardwood floor 22 and vinyl 28 rests on a substrate or subfloor 30.

Figure 6:
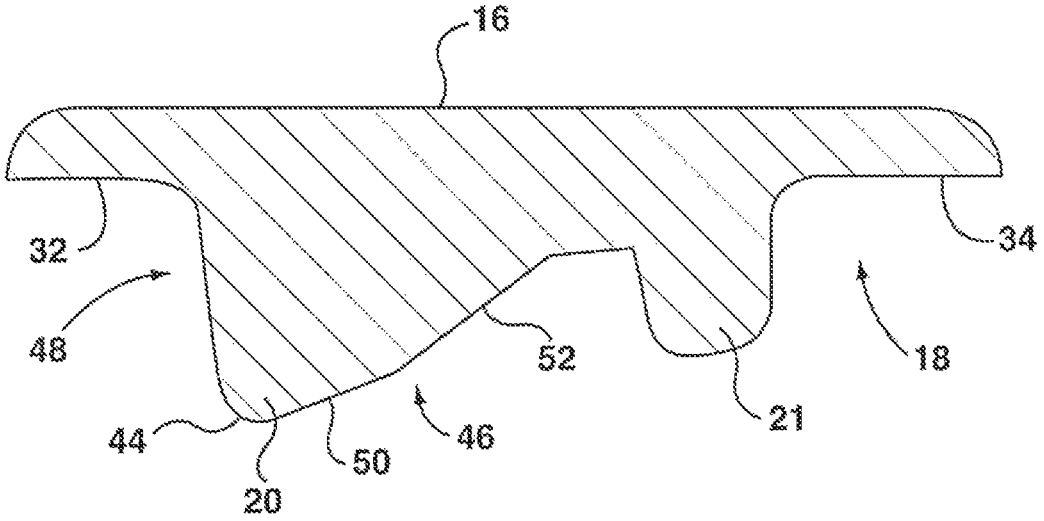
FIG. 6 is an end or cross-sectional view of the TRANSITION STRIP.

The lower surface 18 presents a first lower surfaced portion 32 extending outwardly from the first support or leg 20 as well as a second lower surface portion 34 extending outwardly from the second support or leg 21 as shown in FIG. 6.

In particular FIGS. 3-5 show a transition strip 10 for covering a gap 36 between two spaced floor finishes 22 and either 24, 26, or 28 on a subfloor 30 which comprises a strip 10 extending along a longitudinal axis 12 presenting a cross-section to the longitudinal axis an upper surface 16 which is adapted to cover the gap 36.

Furthermore, FIG. 6 illustrates spaced first and second supports or legs 20 and 21 depending from the strip where the first leg 20 is longer than the second leg 21. The first lower surface portion 32 extends outwardly from the first support or leg 20 and is adapted to cover one edge 40 of the floor finish 22. The second lower surface portion 34 extends outwardly from the second support or leg 21 and is adapted to cover another edge 42 of a floor finish.

The first leg 20 has a rounded bottom 44 and in one embodiment as illustrated in FIG. 3 is adapted to contact substrate or subfloor 30.

The first leg 20 also has an inner surface 46 and an outer surface 48 that converges with the rounded bottom 44 as shown. More particularly, the inner surface 46 presents a first angled portion 15 and a second angled portion 52 which are disposed at different angles as shown. In another embodiment of the invention as shown in FIG. 5, the first angled portion 50 is adapted to contact the substrate or subfloor 30 as shown. Furthermore, the second support or leg 21 can be removed as shown in FIG. 5 so that the transition strip 10 can be easily adapted for a large difference in the heights of the different floor finishes.

Figure 7:
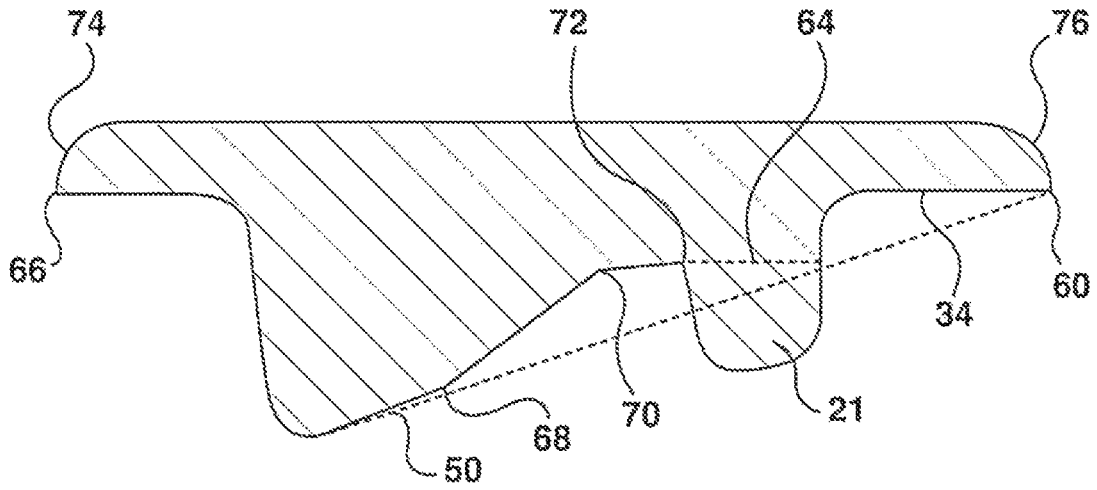
FIG. 7 is another end view of the TRANSITION STRIP.

FIG. 7 shows that generally speaking, the first angled surface 50 lines up with the distal point 60 presented by the second lower portion 34 so as to strengthen and rigidify the orientation of the transition strip 10 in the orientation shown in FIG. 5.

Moreover, the second support or leg 21 can be removed at different positions such as shown by line 62 in FIG. 5 or 64 in FIG. 7.

Moreover, when the transition strip 10 rests on a subfloor or substrate as shown in FIG. 3 the upper surface 16 is disposed at an acute angle a. In one embodiment, the acute angle a is 10 degrees.

Furthermore, edges 60, 66, 68, 70 and 72 can be rounded. Moreover, the upper surface 16 has rounded distal ends 74 and 76.

The profiles show embodiments of the invention and may be varied for example by varying the space between points 70 and 72 from zero to the distance shown in FIG. 7.

In one embodiment, the transition strip may have a lateral dimension of 2¼ Inches from points 60 to 66 with a height of 9/16 inches from first lower surface portion 32 to the distal end of rounded bottom 44 with a dimension of ⅛ inches thickness between the upper surface 16 and lower surface 18 and a ⅜ inch distance between, the second lower surface portion 34 and bottom of leg 21. Furthermore, the distance from positions 66 and rounded portion 44 can be ½ inch and the distance between point 60 and second leg 21 can also be ½ inch. However, the dimensions have been added for illustration purposes and should not be used to limit the invention as other dimensions can be used.

Furthermore, FIG. 3 illustrates that the first lower surface portion covers the edge 41 while at the same time contacting an edge 40 of hardwood which has a tongue portion 43. The second lower surface portion overlies the edge of the carpet 24.

The transition strip 10 can be comprised of a variety of materials including wood, plastics, resins, or composites thereof or the leg. The upper surface 16 may also have a printed surface adhered thereto to simulate wood pebbles or the like. The transition strip 10 can be nailed to the floor finishes, glued or fastened by a variety of means.

Accordingly, the transition strip described herein is universal in the sense that one strip may be used to replace a substantial variety of prior art reducers previously described.

Furthermore lumber suppliers can substantially reduce the number of transition strips carried thereby simplifying their inventory tracking and cost of tracking.

The invention described herein relates to a method of covering a gap 36 between a first floor finish 22 and a second spaced floor finish 24, 26 or 28 on a substrate 30 comprising:

(a) placing a transition strip 10 having art upper surface 16 and two spaced legs 20 and 21 depending from the strip 10, where one of the legs 20 is longer than the other 21 and the legs are disposed within the gap 36.

(b) selectively orientating the transition strip where the upper surface 16 covers the gap 36 and:

(i) is substantially horizontal relative to substrate 30 with the legs 20, 21 spaced from the substrate; or (ii) disposed at a first acute angle a relative the substrate 30 where both legs 20 and 21 contact the substrate 30; or (iii) is disposed at a second acute angle relative to the substrate 30 where one of the legs 20 contacts the substrate and the second leg 21 has been removed so as not to contact the substrate.

In one embodiment of the method the first spaced floor finish is wood and the second floor finish is ceramic tile and the upper surface is substantially horizontal with the first and second legs 20 and 21 spaced from the substrate 30 as shown in FIG. 4.

In another embodiment of the method the first spaced floor finish is wood having a tongue extending therefrom and the second floor finish is carpet, and the upper surface is orientated at a first angle where both legs 20 and 21 contact the substrate 30, as shown in FIG. 3.

In yet another embodiment of the invention, the first floor finish is wood and the second floor finish is vinyl and the second leg has been removed so as not to contact the substrate as shown in FIG. 5.

Figure 8:
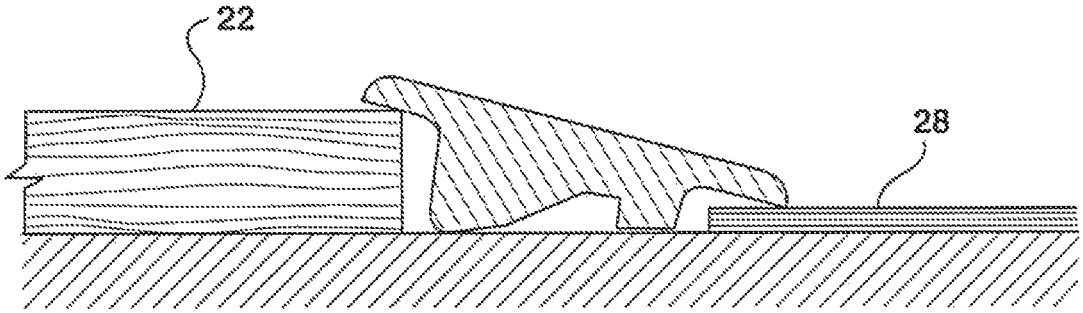
FIG. 8 is a cross-sectional view of another embodiment of the invention.

FIG. 8 shows yet another embodiment of the invention which is similar to FIG. 5 except the wood 22 does not include tongue 43. FIG. 8 shows that second support or leg 21 is partially removed which can rest on substrate 30 and where leg 20 also rests on the subfloor 30. The first lower surface portion 32 covers the edge of wood 22 and the second lower surface portion 34 covers the edge of linoleum 28.

Other floor finishes can be used within the scope of this invention. Having described the invention in detail the examples herein discussed are set forth for illustrative purposes only and not for limitation. The scope of invention is covered by the claims.

I claim:

1. A member for covering an edge of floor finishing means on a subfloor where the member extends longitudinally thereof to present an upper surface, and a lower surface, first and second spaced supports depending intermediate the lower surface, said lower surface having a first lower surface portion and a second lower surface portion where one of said first and second lower surface portions contacts said edge, and said first support is longer than said second support, said first and second supports configured to have different angular orientations relative said subfloor so that said upper surface covers said edge of said floor finishing means; and wherein said first and second supports contact the subfloor.

2. A member as claimed in claim 1 wherein said floor finishing means comprise a first floor finish spaced from a second floor finish, said first floor portion contacting the first floor finish and a second floor portion contacting the second floor finish, and said first support presents a bottom and a first angled portion adjacent said bottom; wherein either one of said bottom or first angled portion selectively contacts said subfloor.

3. A member as claims in claim 2 wherein said first floor finish and said second floor finish is selected from the group consisting of carpet, hardwood floor, wood floor, linoleum, and ceramic tile.

4. A member for covering an edge of floor finishing means on a subfloor where the member extends longitudinally thereof, said member having an upper surface, and a lower surface, first and second spaced supports depending intermediate the lower surface to present a first lower surface portion and a second lower surface portion wherein one of said first and second lower surface portions contacts said edge, and said first support is longer than said second support; wherein said floor finishing means comprise a first floor finish spaced from a second floor finish, said first floor portion contacting the first floor finish and a second floor portion contacting a second floor finish; wherein said first floor finish and said second floor finish is selected from the group consisting of carpet, hardwood floor, wood floor, linoleum, and ceramic tile; and wherein said first and second supports contact the subfloor.

5. A transition strip for covering a gap between two spaced floor finishes on a subfloor comprising:

(a) a strip extending along a longitudinal axis and presenting in cross-section to said longitudinal axis:

(i) an upper surface for covering the gap;

(ii) spaced first and second legs each having a distal end depending from said strip, said first leg longer than said second leg;

(iii) a first lower surface portion extending outwardly from said first leg said first lower surface portion adapted to cover one edge of the two spaced floor finishes;

(iv) a second lower surface portion extending outwardly from said second leg, said second lower portion adapted to cover an edge of the other one of the two spaced floor finishes;

(v) said first leg having a bottom wherein said bottom contacts said subfloor, (vi) said second leg having an angled bottom, wherein said angled bottom contacts said subfloor;

(vii) said first and second legs and said transition strip configured to have different angular orientations relative the subfloor to cover the gap between the two spaced floor finishes on said sub floor;

(viii) where said first lower surface portion and said second lower surface portion are disposed substantially parallel to one another.

6. A transition strip as claimed in claim 5 wherein said bottom presents a rounded bottom and first leg has an inner and outer surface that converges to said rounded bottom.

7. A transition strip claimed in claim 6 wherein said inner surface presents said first angled portion merging with a second angled portion.

8. A method of covering a gap between a first and second spaced floor finish on a substrate comprising:

(a) placing a one piece transition strip having an upper surface extending longitudinally thereof and two spaced legs depending from a lower surface of said strip intermediate distal lateral end portions, wherein one of the legs is longer than the other, and the legs are disposed within the gap;

(b) covering the gap by selectively placing the one piece strip at a first acute angle relative to the substrate wherein both legs contact the substrate; and wherein said spaced legs and upper surface are configured to have different angular orientations relative to said subfloor.

9. A method as claimed in claim 8 wherein the floor finishes are selected from the group consisting of carpet, hardwood floor, wood floor, linoleum, and ceramic tile.

10. A method as claimed in claim 9 wherein said first spaced floor finish is wood and said second floor finish is ceramic tile, and the upper surface is substantially horizontal with said first and second legs spaced from said substrate.

11. A method of covering a gap between a first and second spaced floor finish on a substrate comprising:

(a) placing a transition strip having an upper surface and two spaced legs depending from said strip intermediate first and second bottom contact portions extending outwardly from said two spaced legs, wherein one of the legs is longer than the other, and the legs are disposed within the gap;

(b) selectively orientating the transition strip such that the upper surface covers the gap and the transition strip is disposed at a first acute angle relative to the substrate wherein both legs contact the substrate;

wherein the floor finishes are selected from the group consisting of carpet, hardwood floor, wood floor, linoleum, ceramic tile; and wherein said first space floor finish is wood having a tongue extending therefrom, and the second floor finish is carpet, and the upper surface is orientated at the first acute angle.

12. A method as claimed in claim 11 wherein said first spaced floor finish is a wood having a tongue extending therefrom, and wherein said transition strip includes a first contact bottom portion extending outwardly from said first leg and said first contact bottom portion contacts said tongue of said wood.

13. A method as claimed in claim 11 wherein said second bottom contact portion touches said vinyl and said first bottom contact portion touches said wood.

14. A method as claimed in claim 11 wherein said first leg has a rounded bottom and an inner and outer surface that converges to said rounded bottom, said inner surface having a first angled portion merging with a second angled portion, and wherein said first angled portion touches said substrate.

* * * * *